United States Patent [19]

Miura

[11] 3,978,581

[45] Sept. 7, 1976

[54] METHOD OF MAKING A PIN PLUG

[75] Inventor: Yoshihiko Miura, Tokyo, Japan

[73] Assignee: Yuko Shindosho Company Limited, Tokyo, Japan

[22] Filed: Feb. 12, 1975

[21] Appl. No.: 549,236

Related U.S. Application Data

[62] Division of Ser. No. 525,266, Nov. 19, 1974, abandoned.

[30] Foreign Application Priority Data

| | | |
|---|---|---|
| Feb. 23, 1974 | Japan | 49-22176[U] |
| Oct. 11, 1974 | Japan | 49-116936 |
| Apr. 4, 1974 | Japan | 49-37894[U] |
| May 9, 1974 | Japan | 49-52392[U] |

[52] U.S. Cl. ..... 29/630 A; 29/628; 29/629; 264/272; 339/182 R

[51] Int. Cl.[2] ..... H01R 9/00

[58] Field of Search ..... 29/630 A, 630 R, 629, 29/628, 203 S, 203 P, 203 DS, 203 DT, 203 D, 206 R; 339/177 R, 177 E, 182 R, 183, 275 R, 275 T, 276 T; 264/272; 113/119

[56] References Cited

UNITED STATES PATENTS

| | | | |
|---|---|---|---|
| 2,558,052 | 6/1951 | Klumpp | 113/119 X |
| 2,861,324 | 11/1958 | Klumpp | 29/630 A |
| 2,973,501 | 2/1961 | Mapelsden et al. | 339/276 T X |
| 3,093,434 | 6/1963 | Francis | 264/272 X |
| 3,328,504 | 6/1967 | Hamel | 264/272 |
| 3,444,618 | 5/1969 | Sorlie | 264/272 X |
| 3,470,529 | 9/1969 | Klumpp | 113/119 X |

*Primary Examiner*—C.W. Lanham
*Assistant Examiner*—James R. Duzan
*Attorney, Agent, or Firm*—Lawrence I. Field

[57] ABSTRACT

A pin plug comprises a plug cover made of a substantially cylindrical body of a metal and having a front end divided into several branches and a pin made of a substantially tubular body of a metal and arranged inside of said plug cover coaxially therewith, two conductors of an electric wire being connected to said plug cover and pin, respectively by soldering or clamping. The pin plug further comprises a molded body of electrically insulating synthetic resin which covers the rear ends of said plug cover and pin and that end of the electric wire which is connected to said plug cover and pin, so that the plug cover and pin are fixed in position without using an electrically insulating plate.

4 Claims, 18 Drawing Figures

METHOD OF MAKING A PIN PLUG

This application is a division of application Ser. No. 525,266, filed Nov. 19, 1974 and now abandoned.

BACKGROUND OF THE INVENTION

The present invention relates to a pin plug comprising a plug cover made of a substantially cylindrical body of a metal and having a front end divided into several branches, a pin made of a substantially tubular body of a metal which is arranged inside of said plug cover coaxially therewith, two conductors of an electric wire being connected to said plug cover and pin, respectively and a molded body of electrically insulating synthetic resin which covers the rear ends of the plug cover and pin and that end of the electric wire which is connected to the plug cover and pin.

Such a pin plug has been widely used for interconnecting in a simple and stable manner various electronic devices such as a radio receiver, a television receiver, a disc player, a tape recorder, an audio amplifier, etc.

In a known pin plug which has been commercially available a plug cover and a pin are fixed in position by means of an electrically insulating plate prior to molding. That is to say in a first step of manufacturing process the pin of a metal tube is fixed to the insulating plate by means of clamping. Then the insulating plate is fixed in the plug cover by clamping. In this manner the plug cover and pin are fixed in position with the aid of the insulating plate. Next to the pin and plug cover are connected two conductors of an electric wire by means of soldering. Finally the assembly is molded with synthetic resin. Such a known pin plug requires at least one insulating plate in addition to the plug cover and pin, so that manufacturing process becomes complicated. Particularly the process for assembling the plug cover and pin with the aid of the insulating plate is rather complicated. Thus the known pin plug could not be manufactured automatically. Moreover since the insulating plate exposes to the outside, wet-proof of the insulating resistance is liable to be deteriorated. Thus attention should be paid in selecting material of the insulating plate.

The present invention has for its object to provide a pin plug of a novel construction which does not require the insulating plate, so that it can be manufactured in a very simple and inexpensive manner and also has good electrical and mechanical properties.

It is another object of the invention to provide a pin plug in which the plug cover can be firmly coupled with the molding body of synthetic resin.

It is another object of the invention to provide a pin plug which is particularly suitable to be manufactured in a substantially automatic manner.

It is still another object of the invention to provide a method for manufacturing a pin plug in a mass production manner.

SUMMARY OF THE INVENTION

A pin plug according to the invention comprises a plug cover made of a substantially cylindrical metal body and having a front end divided into several branches, a pin made of a substantially tubular metal body and arranged inside of said plug cover coaxially therewith, to said plug cover and pin being connected two conductors of an electric wire and a molded body of electrically insulating synthetic resin applied to the rear ends of said plug cover and pin and that end of said electric wire which is connected to said plug cover and pin, whereby said plug cover and pin are fixed in position with the aid of said molded body.

In one embodiment of the pin plug according to the invention the plug cover and pin are provided with lugs at their rear ends and the two conductors of the electric wire are connected to these lugs by soldering or clamping.

In another embodiment of the pin plug according to the invention the plug cover is formed by bending a metal plate into a substantially cylindrical body having a substantially C-shaped cross section and the pin is also formed by bending a metal plate into a tubular body having a circular cross section, whereby a width of a slit formed by side edges of the plug cover plate is slightly larger than a diameter of the pin. In such a construction the pin may be inserted into the plug cover through the slit of the plug cover even after having connected the electric core wires to the plug cover and pin.

The present invention also relates to a novel method for manufacturing a pin plug, and said method comprises a step of forming from an elongated metal plate a pin array having successive pins each of which has a tubular body with a semispherical tip and a U-shaped clamping terminal disposed at the other end of the tubular body and intermediate strips for connecting successive pins as an integral body, a step of forming from an elongated metal plate a plug cover array having successive plug covers each of which has a substantially cylindrical body having a front end divided into several branches and a U-shaped clamping terminal disposed at the other end of said body and interconnecting strips for connecting successive plug covers as an integral body, a step of connecting one of conductors of an electric wire to said U-shaped clamping terminal of the pin by means of clamping, a step of separating the pin having the conductor connected thereto from said pin array, a step of connecting the other conductor of said electric wire to said U-shaped clamping terminal of the plug cover by means of clamping, a step of separating the plug cover having the conductor connected thereto from said plug cover array, a step of inserting said pin into said plug cover, a step of arranging said pin and plug cover in position in a mold and a step of injecting synthetic resin into said mold so as to form a molded body applied to the rear ends of said pin and the plug cover and that end of the electric wire which is connected to the pin and plug cover.

BRIEF DESCRIPTION OF THE DRAWINGS

Now the present invention will be explained in detail with reference to the accompanying drawings, in which.

DESCRIPTION OF THE PREFERRED EMBODIMENTS

Figure 1:
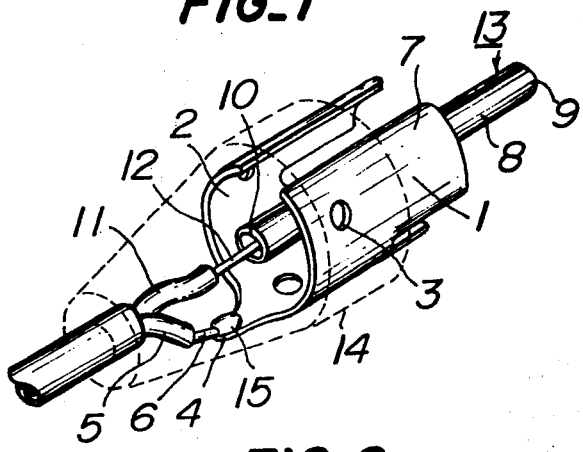
FIG. 1 is a perspective view showing the construction and arrangement of the plug cover and pin in a first embodiment of the pin plug according to the invention.
Figure 2:
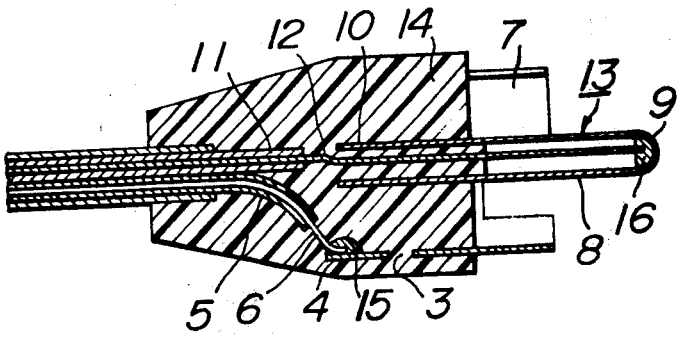
FIG. 2 is a cross section illustrating the complete pin plug of this embodiment.
Figure 3:
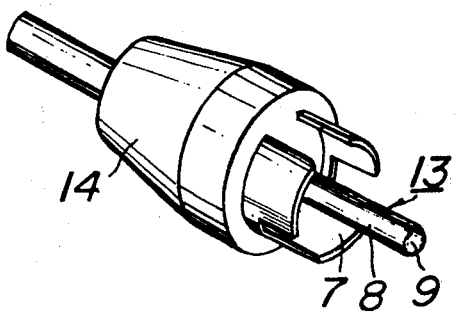
FIG. 3 is a perspective view depicting an external appearance of the pin plug of this embodiment.

FIG. 1 shows the construction and arrangement of a plug cover 7 and a pin 13 of first embodiment of the pin plug according to the invention. The plug cover 7 is formed of a substantially cylindrical body 1 of a suitable metal. The front end of the plug cover 7 is divided into three branches and near the rear end 2 of the plug cover 7 there are formed three through holes 3. A portion of the periphery of the rear end 2 is extended in a longitudinal direction so as to form a lug 4 to which a conductive core 6 of an electric wire 5 is connected by soldering as shown by a reference numeral 15. The pin 13 is formed of a metal tube 8 having semispherical tip 9. A conductive core 12 of the other electric wire 11 is inserted into the tube 8 and is soldered to the inner surface of the tip 9 as shown by a reference numeral 16 in FIG. 2. The pin 13 is arranged inside of the plug cover 7 coaxially therewith. The rear ends of the plug cover 7 and pin 13 and those ends of the electric wires 5 and 11 which are connected to the plug cover and pin are covered with a molded body 14 of an electrically insulating synthetic resin as shown in FIG. 2. The external appearance of the pin plug of this embodiment is shown in FIG. 3.

The pin plug according to the invention requires only two parts, i.e., the plug cover 7 and pin 13 prior to molding and they need not be assembled prior to molding in contrast with the known pin plug in which the plug cover and pin must be assembled with the aid of the insulating plate prior to molding. That is to say according to the invention after the conductors 6 and 12 are connected to the plug cover 7 and pin 13, respectively and the pin 13 is inserted into the plug cover 7, they are arranged in a mold of a suitable construction in such a manner that they are situated concentrically in position relative to each other and then synthetic resin is injected into the mold to form the molded body 14. To this end the mold may be provided with a surface which corresponds to a front surface of the molding body 14 and has a substantially circular recess and a central hole. In arranging the plug cover 7 and pin 13 in such a mold, the front end of the plug cover 7 is inserted into said circular recess and the pin 13 is inserted into said center hole, so that the plug cover 7 and pin 13 can be arranged in position accurately. In this case use can be made of the mold of precise dimensions and thus the eccentricity of the plug cover 7 and pin 13 can be sufficiently limited within a given allowance.

The holes 3 formed in the plug cover 7 serve to connect the synthetic resin portions at inside and outside of the plug cover 7 so as to increase the mechanical coupling force between the plug cover 7 and the molded body 14.

Figure 4:
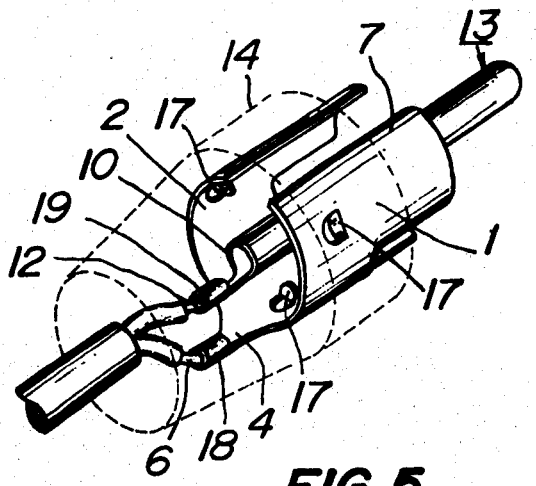
FIG. 4 is a perspective view showing the construction and arrangement of a second embodiment of the pin plug according to the invention.

FIG. 4 shows another embodiment of the pin plug according to the invention. In FIG. 4 in order to illustrate clearly the construction and arrangement of the plug cover 7 and pin 13, the molded body 14 is depicted by a dotted line in the same manner as FIG. 1. In this embodiment the plug cover 7 is also formed of a substantially cylindrical body 1 of a metal and is provided with three projections 17 near its rear end 2 by making semicircular cuts in the body 1 and then bending towards inside of the body 1. The rear end 2 of the body 1 is further provided with a lug 4 which has a U-shaped clamping terminal 18 at its free end. A conductor 6 is connected to this terminal 18 by clamping. The pin 13 also has a U-shaped clamping terminal 19 at its open end 10 and a conductor 12 is connected to this terminal 19 also by clamping. The plug cover 7 and pin 13 are arranged in position in a mold and then synthetic resin is injected into the mold so as to form a molded body 14.

Figure 5:
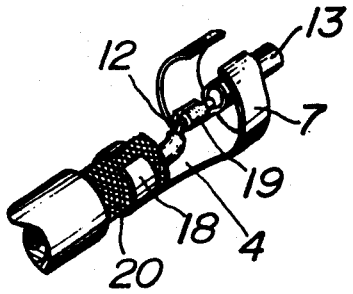
FIG. 5 is a perspective view illustrating a part of the plug cover of still another embodiment of the pin plug according to the invention.

When use is made of the clamping terminal 18 for the plug cover 7, it is quite convenient to connect to this terminal 18 a coaxial cable having a shielding wire. That is to say as shown in FIG. 5 the size of the U-shaped clamping terminal 18 is made large and the shielding wire 20 is connected to the terminal 18 by directly clamping the wire. In this case the mandrel 12 may be connected to the pin 13 by means of clamping as shown in FIG. 5 or soldering.

When the plug cover 7 having the U-shaped clamping terminal 18 and the pin 13 having the U-shaped clamping terminal 19 are used, it is possible to connect the electric wire to the pin plug in a very simple and efficient manner and the pin plug according to the invention can be manufactured automatically as explained in detail later.

Figure 6:
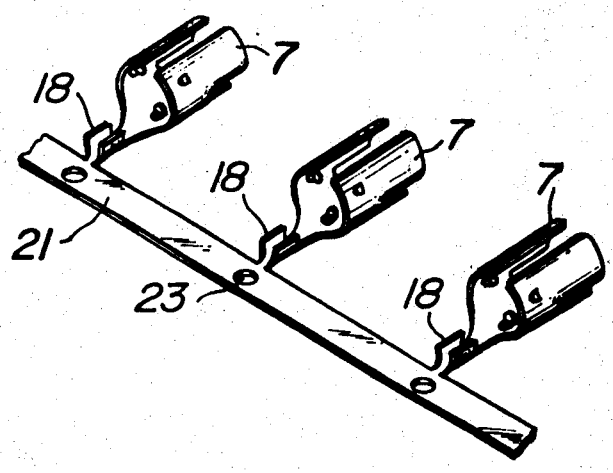
FIG. 6 is a perspective view showing a plug cover array with can be used for manufacturing automatically the pin plug of FIG. 4.
Figure 7:
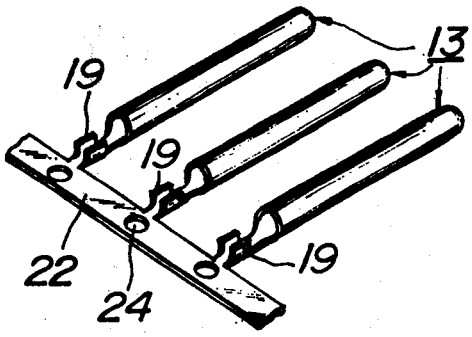
FIG. 7 is also a perspective view illustrating a pin array which can be used for manufacturing automatically the pin plug of FIG. 4.

As shown in FIGS. 6 and 7 a number of plug covers 7 and pins 13 are formed from elongated metal plates by pressing them continuously with using suitable press machines. The plug covers and pins are connected to each other by means of connecting strips 21 and 22, respectively. The strips 21 and 22 are further provided with indexing holes 23 and 24, respectively, for introducing them intermittently into clamping presses at given positions at a given interval. In the clamping presses the mandrels 6 and 12 of the electric wire are inserted into the U-shaped clamping terminals 18 and 19, respectively and then are connected to these terminals by clamping. At the same time the plug cover 7 and pin 13 are separated from the strips 21 and 22, respectively. In this manner the plug cover 7 and pin 13 having the electric wire connected thereto can be obtained automatically. By means of such process it is possible to connect automatically 60 electric wires to the plug covers 7 and pins 13 in 1 minute. Moreover the clamping press may be provided with machine for stripping off an insulating coat of the electric wire. In this case it is possible to expose automatically the tips of mandrels of the electric wire.

Figure 8:
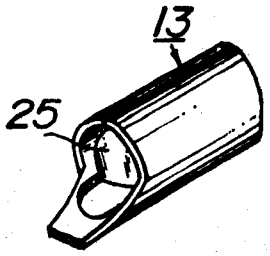
FIG. 8 is a partial perspective view showing a construction of another embodiment of a pin according to the invention.

In order to avoid synthetic resin in molding from entering into the pin 13 and exuding from a slit of the pin 13, in the embodiment of FIG. 1 the open end 10 of the pin 13 may closed by pressing it after soldering the conductor 12 to the pin 13, further in case of using the clamping terminal a part of the rear end 10 of the pin 13 is cut into a semicircular portion 25 as shown in FIG. 8 and this portion 25 is bent in such a manner that the portion 25 closes the open end of the pin 13.

Figure 9:
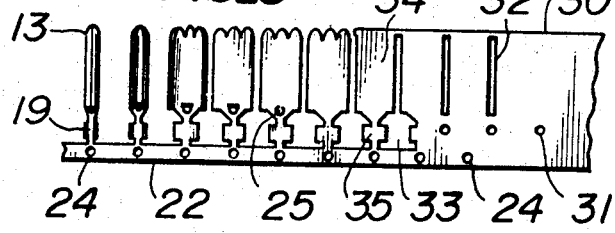
FIG. 9 is a plan view showing successive steps for manufacturing a pin array which is used in the manufacturing method according to the invention.

FIG. 9 is a plan view showing a manner of manufacturing the pin array from an elongated metal sheet 30. The metal sheet 30 may be a brass sheet having a thickness of 0.4 mm and a width of 29 mm. Successive steps are effected upon the metal sheet 30 from the right to the left of the drawing so as to manufacture the pin array as shown in FIG. 7. At first there is formed a circular pilot hole 31 which serves to index the metal sheet 30 in the next step. Then there is formed a slit 32 which will separate adjacent pins. Next there is formed an indexing circular hole 24 which will engage with a pawl for transporting the metal sheet intermittently in a clamping machine. Then a portion 33 of the sheet 30 near the lower edge is punched to form a pin plate 34, a clamping terminal plate 35 and a connecting strip 22. The punched portion 33 communicates with the slit 32. Next the upper edge of the pin plate 34 is divided into three shallow branches and at the same time the upper edge of the pin plate 34 is separated from the metal sheet 30. If necessary the edge of the clamping terminal plate 35 may be rounded off. Further at the lower end of the pin plate 34 there is formed a semicircular cut portion 25. Then this cut portion 25 is bent so as to form the stopper 25 as shown in FIG. 8. Next the side edges of the pin plate 34 and the clamping terminal plate 35 are slightly bent. In the next step these side edges are further bent to such an extent that the cross section of the pin plate 34 becomes C-shape and that of the clamping terminal plate 35 becomes U-shape. In the final step the pin plate 34 is further bent and its top end is made semispherical so as to form a completely tubular pin 13 with the semispherical tip 9.

Figure 10:
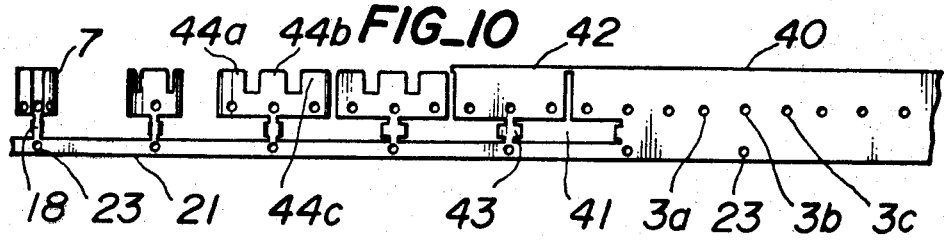
FIG. 10 is a plan view illustrating successive steps for manufacturing a plug cover array which is also used in the manufacturing method of the invention.

Next a manner of manufacturing the plug cover array shown in FIG. 6 will be explained in detail with reference to FIG. 10. The plug cover array is also formed by pressing a metal plate 40 which may be a brass plate having a thickness of 0.4 mm and a width of 20 mm. At first there are formed three circular pilot holes 3*a*, 3*b* and 3*c* which serve to index the metal sheet 40 in the press machine and also to increase the coupling of the plug cover and the molding body in the completed pin plug as already explained above. Next there is formed an indexing hole 23 near the lower edge of the metal sheet 40. This indexing hole 23 engages with a pawl of the clamping machine in a later step. Then there is formed a substantially T shaped hole 41 so as to constitute a plug cover plate 42, a clamping terminal plate 43 and a connecting strip 21. The upper edge of the plug cover plate 42 is divided into three branches 44a, 44b and 44c and at the same time the plug cover plate 42 is separated from the metal strip 40. If necessary the side edges of the clamping terminal plate 43 may be rounded off. Next the plug cover plate 42 and the clamping terminal plate 43 are bent slightly. Then these plates are further bent to such an extent that the cross section of these plates 42 and 43 becomes U-shape. Thus the clamping terminal 18 is formed. Finally the plug cover plate 42 is further bent so as to form the substantially cylindrical plug cover 7 having the C-shaped cross section. In this manner the plug cover array shown in FIG. 6 is formed.

In a next step of the manufacture each of the electrical conductors of the electric wire is connected to the pin and plug cover, respectively by clamping. In this case it is more convenient to connect one conductor to the pin first and then the other conductor to the plug cover, because the pin is smaller than the plug cover.

In case of connecting the conductor to the pin successive pins of the pin array strip shown in FIG. 7 which is wound on a reel are transported intermittently to a clamping machine by means of which conductors are successively clamped to the clamping terminals 19 of the successive pins 13 and at the same time the pin is separated from the connecting strip 22 of the pin array.

Figure 11:
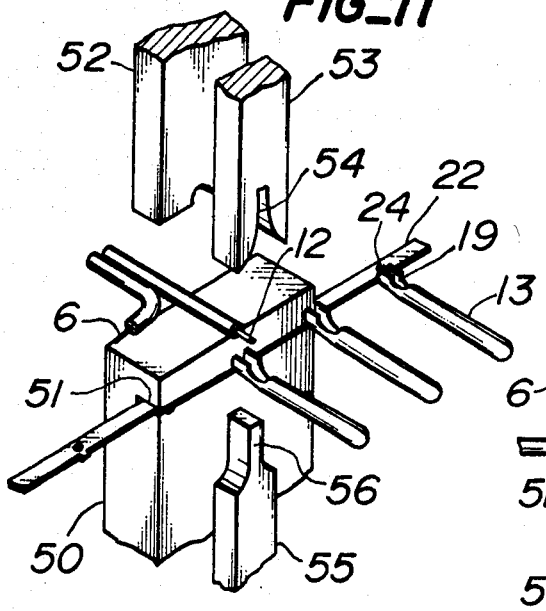
FIG. 11 is a perspective view showing a manner of connecting a conductive core of an electric wire to a pin of the pin array and of separating the pin from the pin array.
Figure 12:
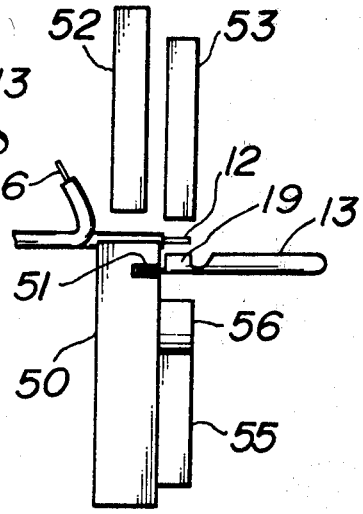
FIG. 12 is a side view of FIG. 11.

FIGS. 11 and 12 show one embodiment of such a clamping machine. This clamping machine comprises a fixed block 50 which has a horizontal slit 51 on its front wall. The width of the slit 51 is slightly larger than the thickness of the connecting strip 22 of the pin array. The connecting strip 22 of the pin array is inserted in the slit 51 and is transported therethrough intermittently by means of the indexing hole 24 which is engaged with the pawl (not shown) of the clamping machine. While the pin array is stopped at a given position of the machine the electrically conductive core wire 12 is placed on the upper surface of the block 50. In this case the wire 12 is situated just above the clamping terminal 19 of the pin 13. The clamping machine further comprises a wire fixing block 52 which moves downward and fixes the wire 12 at a given position. The clamping machine further comprises a clamping upper press 53 having at its lower end a tapered notch 54 and a clamping lower press 55 having at its upper end a narrow projections 56 which may penetrate into the notch 54. The lower press 55 moves upward with sliding on the front wall of the fixed block 50. When the upper press 53 moves downward and the lower press moves upward the conductor 12 is clamped by the clamping terminal 19 of the pin 7 and at the same time the pin 13 is separated from the pin array by means of a shearing force caused by the upward movement of the lower press 55. After clamping the wire fixing block 52 and the upper clamping press 53 move upward to their original positions and the lower clamping press 55 moves downward to its original position. Then the pin array is transported by one pitch by means of the cooperation of the pawl and the indexing hole 24.

Figure 13:
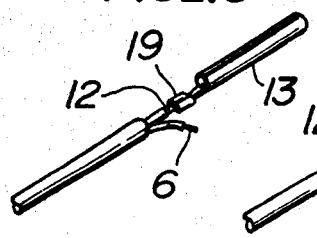
FIG. 13 is a perspective view showing the electric wire one core conductor of which is connected to the pin.

In the manner mentioned above the core conductor 12 of the electric wire is connected to the clamping terminal 19 of the pin 13 and the pin 13 is separated from the pin array. Therefore the pin 13 having the core wire 12 connected thereto can be obtained as shown in FIG. 13. In this case the electric wire may be introduced manually one by one into the clamping machine or may be introduced automatically with synchronism with the transportation of the pin array.

Figure 14:
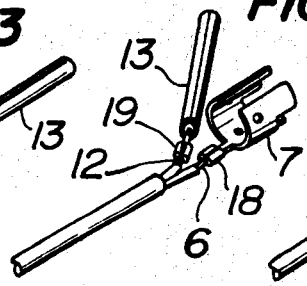
FIG. 14 is a perspective view illustrating the electric wire the other core conductor of which is connected to the plug cover.
Figure 15:
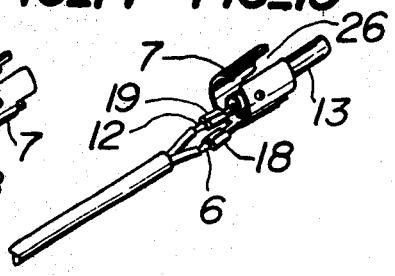
FIG. 15 is a perspective view depicting the assembly of the plug cover and pin which is inserted in the plug cover.

In a manner similar to that explained above the other core conductor 6 is connected to the clamping terminal 18 of the plug cover 7 and the plug cover 7 is separated from the plug cover array. Thus the assembly shown in FIG. 14 can be obtained. Next as shown in FIG. 15 the pin 13 is inserted in the plug cover 7 through a slit 26 formed in the plug cover 7.

Figure 16:
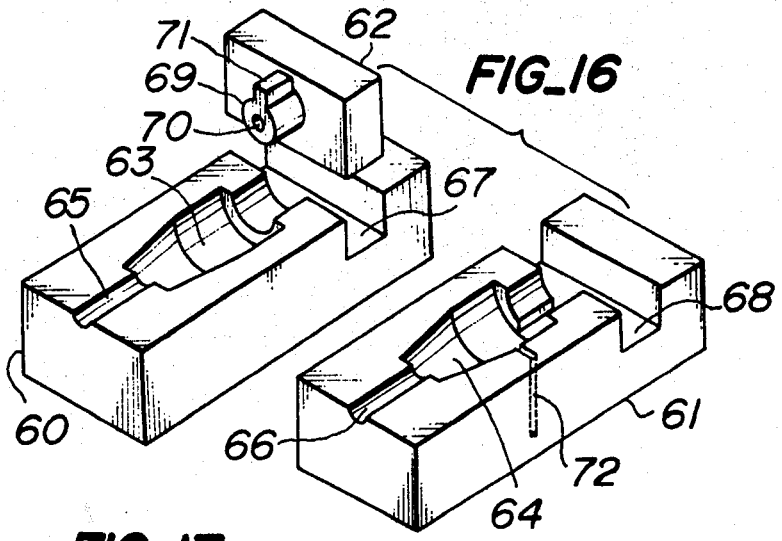
FIG. 16 is a perspective view showing three parts of a mold.

FIG. 16 shows one embodiment of a mold for forming the molded body 14 of the pin plug according to the invention. This mold consists of three parts, i.e., a lower mold part 60, an upper mold part 61 and a nest mold part 62. In the lower and upper mold parts 60 and 61 there are formed symmetrically cavities 63 and 64 for accommodating parts of the pin 13 and plug cover 7, passages 65 and 66 for accommodating the electric wire and recesses 67 and 68 for accommodating the nest mold part 62. The nest mold part 62 comprises a substantially cylindrical projection 69 which has a center hole 70 and a rectangular projection 71. The diameter of the projection 69 is substantially equal to an inner diameter of the plug cover 7 and a diameter of the center hole 70 is substantially equal to the diameter of the pin 13. Further the width of the rectangular projection 71 is substantially equal to the width of the slit 26 of the plug cover 7.

Figure 17:
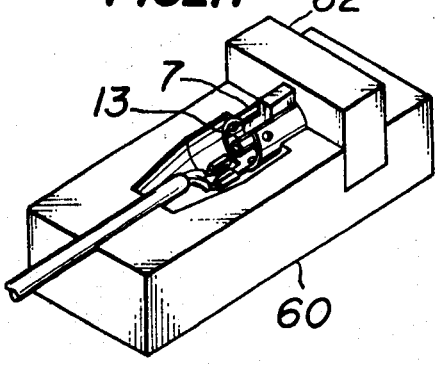
FIG. 17 is a perspective view illustrating the lower mold part of the mold in which the assembly of the plug cover and pin is inserted.

At first the plug cover 7 is inserted into the circular projection 69 of the nest mold part 62 and the pin 13 is inserted into the center hole 70 of the nest mold part 62. In this manner the pin 13 and plug cover 7 can be arranged coaxially with a great precision. Next the nest mold part 62 is inserted in the recess 67 of the lower mold part 60 as shown in FIG. 17. Then the upper mold part 61 is placed on the lower mold part 60 in such a manner that the remaining portion of the nest mold part 62 is fitted in the recess 68 of the upper mold part 61. Then a heated fluid of suitable synthetic resin material is injected into the mold through a conduit 72 so as to form the molded body 14. After the molding material is hardened, the mold is opened and the pin plug shown in FIG. 3 can be obtained.

Figure 18:
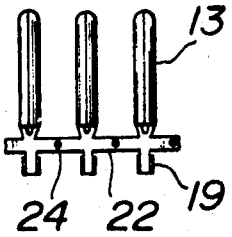
FIG. 18 is a plan view showing another embodiment of the pin array which can be used in the method according to the invention.

The present invention is not limited to the embodiments just explained above, but many modifications are possible within the scope of the invention. For example the numbers of the divided branches of the front end of the plug cover 7, the through holes 3 and projections 17 formed in the plug cover 7 are not limited to those shown in the drawings, but may be selected at will to arbitrary numbers. The projections 17 may be bent towards the outside of the cylindrical body 1. Further the edge of the rear portion 2 of the cylindrical body 1 may be cut to some extent in a longitudinal direction and then a cut portion or portions may be bent towards inside or outside of the body 1. The plug cover 7 may be formed by a completely cylindrical body of a metal. In the embodiment shown in FIG. 7, the pins 13 of the pin array is connected to each other by means of the connecting strip 22 at the lower end of the pins 13. But as shown in FIG. 18 the connecting strip 22 may be provided between the pin 13 and the clamping terminal 19.

The pin plug according to the invention can be manufactured in a very simple and cheap manner. In this case the size and shape of the plug cover 7 and pin 13 are designed in such a manner that when the plug cover 7 and pin 13 are arranged concentrically in the mold, they do not contact with each other, and the plug cover 7 and pin 13 are fixed in position and are not displaced in the axial and circumferential directions. In this case when the plug cover 7 is provided with the holes 3 and/or projections 17, the molding materials at the inside and outside of the plug cover 7 can be united with each other through the holes so that the plug cover 7 can be strongly fixed in position. It was found experimentally that the mechanical properties such as a retaining force of the plug cover 7 and a resistivity of the pin 13 for stress and the electric properties such as an insulating resistance and an anti-breakdown voltage of the pin plug according to the invention are sufficiently good. Particularly since the insulating plate which was required for the known pin plug is not used, the insulating resistance in the wet-proof test of the pin plug according to the inventor is higher than the known pin plug by about 10 times. Moreover when the clamping terminals are used in the pin plug according to the invention, the connection of the electric wire can be effected efficiently as compared with the soldering and further the mechanical strength of the connection is also superior to the soldering. In case of soldering the materials of the plug cover and pin should be carefully selected and in certain cases they must be plated or cleaned.

As explained above in the pin plug according to the invention the number of parts can be minimized because the insulating plate is not necessary. Further the plug cover and pin are not necessary to be assembled previously, so that the manufacturing process can be made simple and inexpensive. Moreover the property of the pin plug according to the invention is by no means inferior to the known pin plug and particularly the electric property is rather superior to the known pin plug. In this manner the pin plug according to the invention can provide a large utility.

What is claimed is:

1. A method for manufacturing a pin plug having a plug cover and a pin arranged inside of the plug cover coaxially therewith, comprising:

forming a pin of a substantially tubular metal body;

forming a plug cover consisting of a substantially cylindrical metal body having a substantially C-shaped cross section which defines a slit which is wider than a diameter of the pin;

connecting two conductors of an electrical wire to the pin and plug cover, respectively, while the pin is positioned outside of the plug cover;

inserting the pin inside of the plug cover through the slit formed in the plug cover;

thereafter inserting the pin and plug cover into a mold member, the pin being disposed coaxially with the plug cover within the mold member; and then injecting synthetic resin inside of the mold member so as to fix the pin and plug cover in position by means of the synthetic resin body thus molded.

2. A method according to claim 1 further comprising:

forming from an elongated metal plate a pin array having a number of pins each of which has a tubular body with a hemispherical tip and a U-shaped clamping terminal and strips for interconnecting successive pins as an integral body;

forming from an elongated metal plate a plug cover array having a number of plug covers each of which has a substantially cylindrical body having a substantially C-shaped cross section to define a slit which is wider than a diameter of the pin and a U-shaped clamping terminal and strips for interconnecting successive plug covers as an integral body;

clamping the two conductors of an electrical wire to the clamping terminals of the pin and plug cover, respectively; and thereafter separating the pin and plug cover from their arrays, respectively.

3. A method according to claim 1, wherein said mold member comprises a lower mold part, an upper mold part and a nest mold part, the lower and upper mold parts having cavities for accommodating the nest mold part and the nest mold part having a circular projection with a center hole and a substantially rectangular projection, and wherein said step of inserting the pin and plug cover into the mold member includes:

the step of inserting the pin into the center hole of the nest mold part;

the step of fitting the plug cover into the circular projection of the nest mold part with its rectangular projection being inserted in the slit formed in the plug cover;

the step of inserting a portion of the nest mold part into the recess of the lower mold part; and the step of placing the upper mold part on the lower mold part with the remaining portion of the nest mold part being disposed in the recess of the upper mold part.

4. A method according to claim 2, wherein the electrical wire is a shielding wire having an outer shielding conductor and a center conductor and the step of clamping the outer shielding conductor to the plug cover includes a step of clamping the whole wire to the clamping terminal of the plug cover.

* * * * *